US006866466B2

(12) United States Patent
Roan et al.

(10) Patent No.: US 6,866,466 B2
(45) Date of Patent: Mar. 15, 2005

(54) FOLDING LIFT ARM ASSEMBLY FOR SKID STEER LOADER

(75) Inventors: Thomas J. Roan, Fargo, ND (US); Larry E. Albright, Gwinner, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/439,772

(22) Filed: May 16, 2003

(65) Prior Publication Data

US 2004/0228715 A1 Nov. 18, 2004

(51) Int. Cl.[7] ..... B66C 23/00
(52) U.S. Cl. ..... 414/686; 414/680
(58) Field of Search ..... 414/686, 680

(56) References Cited

U.S. PATENT DOCUMENTS

| | | | | |
|---|---|---|---|---|
| 1,371,344 | A | 3/1921 | Brackett | |
| 2,455,474 | A | 12/1948 | Drott et al. | 214/131 |
| 2,729,349 | A | 1/1956 | Stueland | 214/140 |
| 2,791,341 | A | 5/1957 | Michaels et al. | 214/141 |
| 3,215,292 | A | 11/1965 | Halls | 214/140 |
| 3,463,335 | A | 8/1969 | Brownell et al. | 214/138 |
| 3,491,906 | A | 1/1970 | Davidson | 214/770 |
| 3,780,895 | A | 12/1973 | Campbell | 214/770 |
| 3,792,786 | A | 2/1974 | Goikhburg et al. | 214/138 |
| 3,802,589 | A | 4/1974 | Holtkamp | 214/770 |
| 3,910,440 | A | 10/1975 | Holtkamp et al. | 214/770 |
| 4,054,216 | A | 10/1977 | Inui et al. | 214/138 |
| 4,388,038 | A | 6/1983 | Freitag | 414/685 |
| 4,465,425 | A | 8/1984 | Schwappach | 414/685 |
| 5,169,278 | A | 12/1992 | Hoechst et al. | 414/685 |
| 5,184,932 | A | 2/1993 | Misuda et al. | 414/685 |
| 5,511,932 | A | 4/1996 | Todd et al. | 414/685 |
| 5,542,814 | A | 8/1996 | Ashcroft et al. | 414/786 |
| 5,609,464 | A | 3/1997 | Moffitt et al. | 414/685 |
| 6,474,933 | B1 | 11/2002 | Hoechst et al. | 414/815 |
| 6,616,398 | B2 | 9/2003 | Dershem et al. | 414/686 |

FOREIGN PATENT DOCUMENTS

| | | |
|---|---|---|
| DE | 25 04 185 | 8/1975 |
| EP | 0 628 664 A | 12/1994 |

OTHER PUBLICATIONS

"345 Mustang Loader", Owatonna Manufacturing Company, Inc. brochure, four pages, publication date 1982.
"445 Mustang Loader", Owatonna Manufacturing Company, Inc. brochure, four pages, publication date Jan. 1980.
"545 Mustang Loader", Owatonna Manufacturing Company, Inc. brochure, four pages, publication date 1980.

*Primary Examiner*—Donald W. Underwood
(74) *Attorney, Agent, or Firm*—Westman, Champlin & Kelly, P.A.

(57) ABSTRACT

A lift arm assembly for a skid steer loader comprises a pair of lift arm links that are pivotally mounted together at first ends of the links. A first lift arm link is of substantial length and is pivotally mounted to the frame of the skid steer loader adjacent the rear lower portion of the frame and extends upwardly. A second lift arm link extends forwardly from the first lift arm link pivot to a position ahead of the skid steer loader frame. A control link is provided that has one end pivotally mounted to the loader frame adjacent a forward end of the loader frame, and a second end pivotally mounted to the second lift arm link to guide the second lift arm link as it is raised. An extendable and retractable actuator is pivotally mounted at a first end to the first lift arm link adjacent to the pivot of the first lift arm link to the frame. A second end of the actuator is pivotally mounted to the second lift arm link forwardly of the first lift arm length link. The control link is of length, and its pivots are located such that the outer end of the first lift arm link moves in a substantially vertical path as the actuator is extended and retracted.

16 Claims, 8 Drawing Sheets

FOLDING LIFT ARM ASSEMBLY FOR SKID STEER LOADER

BACKGROUND OF THE INVENTION

The present invention relates to a lift arm assembly using a folding linkage, including guide links to provide for a desired path of movement of the outer end of the lift arm assembly, which is used for supporting a bucket, or implement. The folding linkage includes main support links that are pivotally mounted at a lower rear portion of the skid steer loader frame, and extend uprightly, and side lift arms pivoted to the main support links. Hydraulic cylinders acting between the main support links and lift arms raise and lower the lift arms while the arms are guided in a path by guide links attached to forward portions of the frame. The lift arm assembly is sturdy, easily operated, and provides a substantially vertical path of movement of the outer ends of the lift arm assembly.

In the prior art, a number of different types of linkages have been used to guide the outer ends of loader lift arms in a vertical or "S" shaped path, many of the linkages are very successful. In particular, U.S. Pat. Nos. 5,169,278 and 6,474,933 show linkages for obtaining a generally vertical paths using multiple link lift arm assemblies. The hydraulic actuators used for each of these prior art loader lift arms have base ends anchored to the frame of the skid steer loader. Also, the lift arms are pivotally connected to upper ends of frame uprights.

Another type of extendable reach lift arm assembly is disclosed in U.S. Pat. No. 3,802,589, wherein the lift arms are attached to a movable frame that is pivotally mounted at a lower edge of the truck or vehicle frame, with at least one pair of hydraulic actuators needed for operating the lift arm assembly. A loader lift arm assembly that is guided by a linkage supported at an upper, forward side of a loader cab is shown in U.S. Pat. No. 5,542,814.

Skid steer loaders typically have a cross member that connects the lift arm supports above the engine compartment and to the rear of the cab. The upper cross member hinders access to components below the cross member.

SUMMARY OF THE INVENTION

The present invention relates to a loader lift arm assembly that provides a desired path of vertical movement of a bucket or tool, utilizing a lift arm linkage that includes an upright main support link or post on each side of a loader held together to move as an assembly. The assembly of the main upright links or posts is pivotally mounted at the lower rear portions of the loader on which the lift arm assembly is used. Forwardly extending lift arms are pivoted at the upper ends of the main support links. A hydraulic actuator is connected between each upright main support link or post, and the associated forwardly extending lift arm to provide a scissors-action control for actuating the lift arm assembly.

A control link is also used on each side of the loader for guiding the path of the forwardly extending lift arms and controlling the outer ends of the lift arms to move substantially vertically between a lowered position and a fully raised position while the actuators are elongated and the lift arms pivot relative to the main support links. While there normally is a main support link, a lift arm and a control link on each side of the loader, a single support link, lift arm and control link can be used.

The main support link assembly is pivoted to the lower rear of the loader frame. A torsion connection tube connects the upright main support links or posts on opposite sides of the rear of the loader frame and the connection tube is supported on spaced pivot bearings so the main support link assembly is stable. The hydraulic cylinders or actuators connected between each upright main support link or post and the respective lift arm provide an adequate amount of leverage or lifting capacity for a given size of hydraulic actuator. The hydraulic cylinders operate with a relatively short stroke.

The bases of the hydraulic actuators for the lift arms are thus not attached to the loader frame. The control links between the loader frame and the forwardly extending lift arms guide the path of movement of the pivoting main support upright links or posts as well. The geometry of the upright links, the lift arms and the control links, including the link length ratios, and the location of the pivot points relative to the skid steer loader frame provide the desired lift path.

The present lift arm assembly provides efficient raising and lowering of buckets or tools, while accomplishing the desirability of a substantial vertical path of travel of the outer ends of the lift arms.

DETAILED DESCRIPTION OF THE PREFERRED EMBODIMENTS

Figure 1:
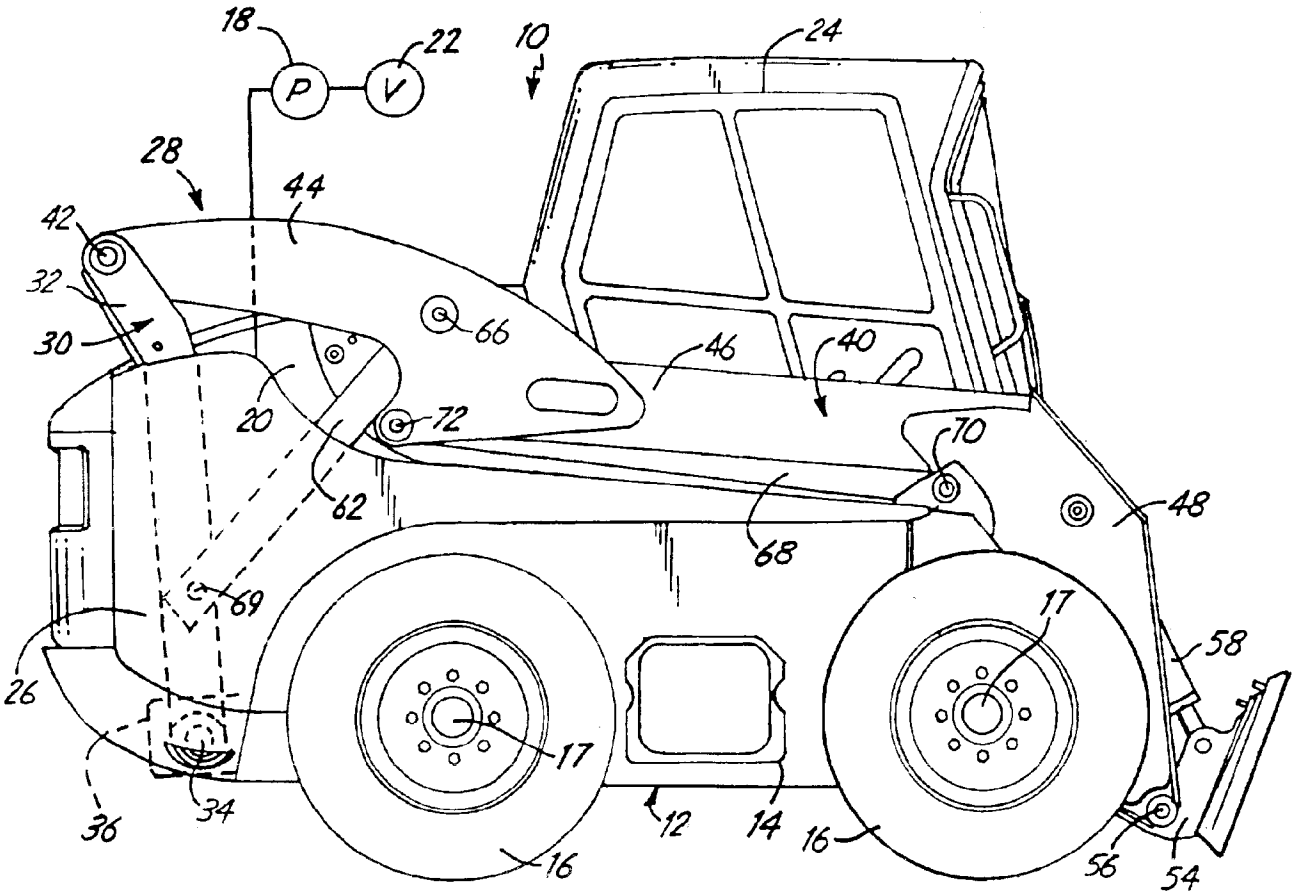
FIG. 1 is a side elevational view of the skid steer loader having lift arms made according to the present invention installed thereon.

Loader assembly 10 includes a skid steer loader frame 12, that includes a longitudinally extending transmission housing 14. The frame 12, as is conventional, is supported on drive wheels 16 on opposite sides of the loader, in the normal manner. Axles 17 are driven by hydraulic motors operated by fluid under pressure from a pump 18 driven from an internal combustion engine in an engine compartment 20. Valves 22 are used for operating various hydraulic components, including the hydraulic motors for driving the axles 17. An operator's compartment 24 is provided on the frame, in which the operator controls are located, for controlling the various functions of the loader.

Figure 8:
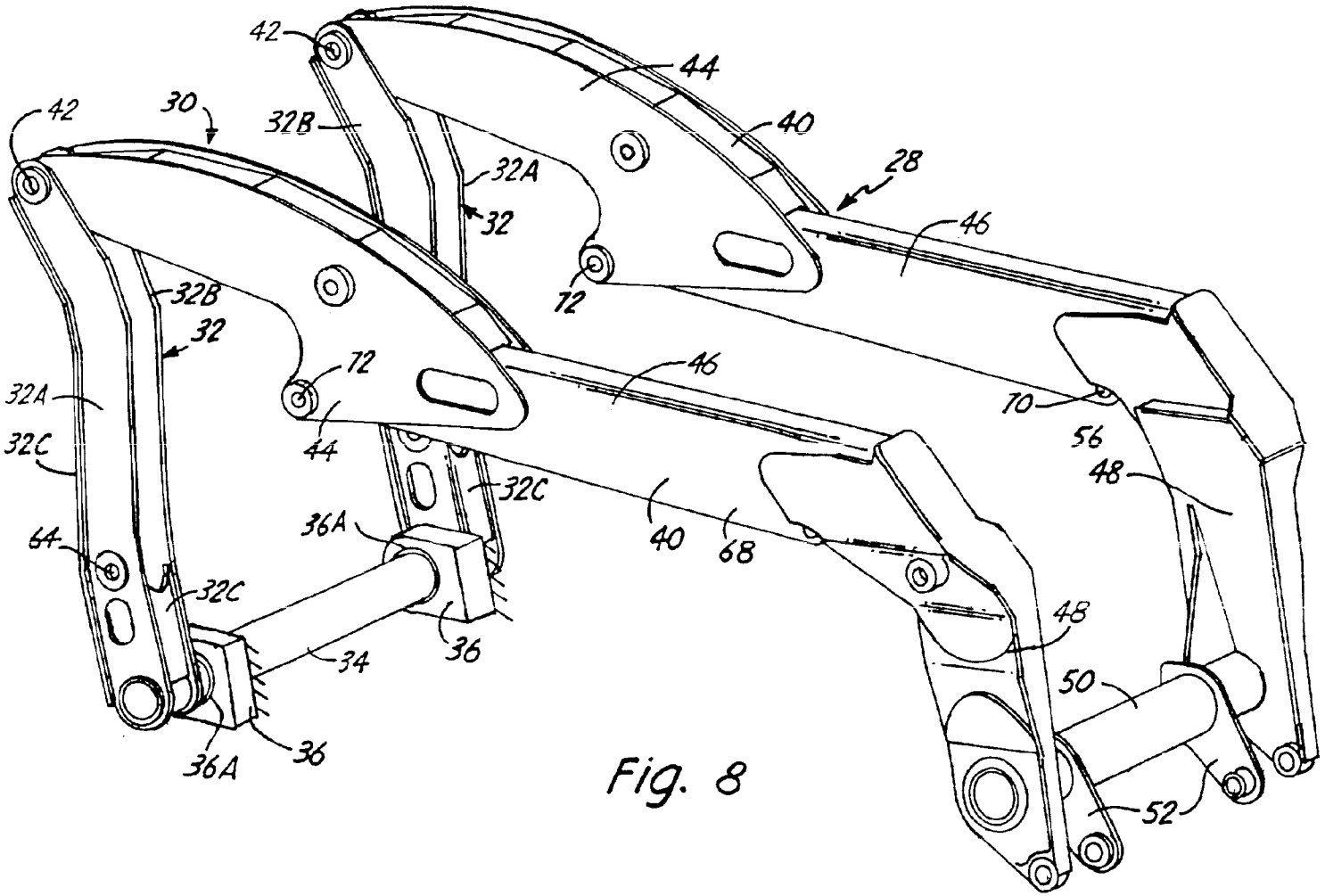
FIG. 8 is a front perspective view of the lift arm assembly removed from the frame of the skid steer loader, and without the actuators in place.

The loader frame 12 has side panels 26 at the rear that are spaced apart to provide a space for movement of portions of the lift arm assembly 28. Specifically, a main lift arm support frame 30 forming part of the assembly 28 comprises a pair of main support upright links or posts 32, which are joined together with a rigid lower cross tube 34 (see FIG. 8). The cross tube 34 has bearing journals thereon, which are supported on suitable bearings indicated schematically at 36, on the transmission frame or case 14. Only one bearing is shown in FIG. 8. Bearings are provided on both of the journals that are shown at 36A as well in FIG. 8. The bearings are below the engine compartment 20 and at the rear of the frame. The cross tube 34 carries the torsional load and is very stable. The cross tube is at a level about even with the axles 17 at the lower side of the frame. There is no cross member needed above the engine compartment or above the cross tube 34. This leaves the space above the engine compartment unobstructed to rearward visibility and access.

The upright links or posts 32 are formed with spaced apart side wall panels 32A and 32B that are joined together with a cross plate 32C to form a forwardly open channel. The side plates 26 are configured to provide for clearance during the pivoting of the frame 30 and the upright links or posts 32 about the pivot bearings 36 during operation, as will become apparent.

Figure 4:
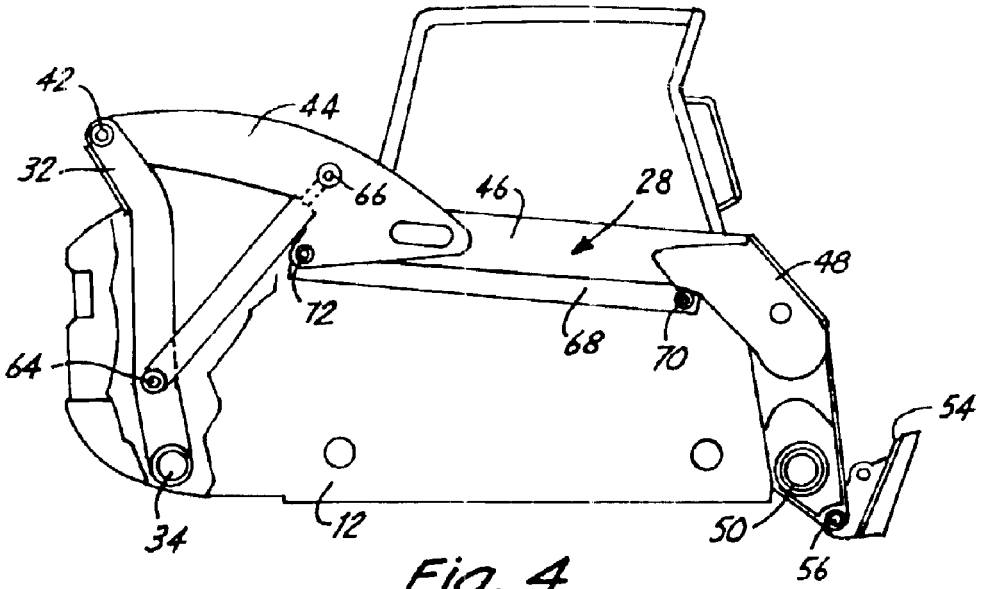
FIG. 4 is a view of the frame assembly of the skid steer loader, with the lift arm assembly in a lowered position, and with parts broken away.
Figure 5:
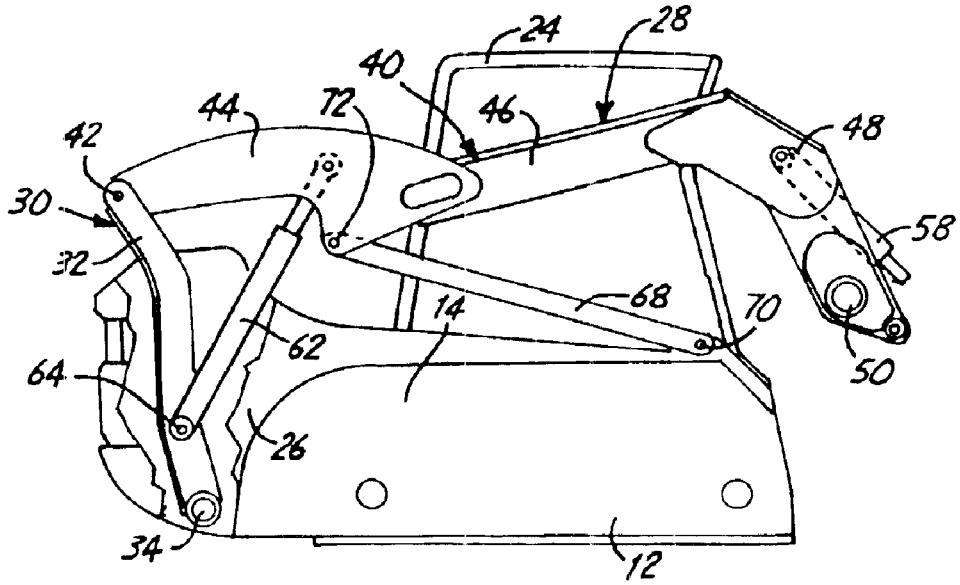
FIG. 5 is a view similar to FIG. 4, with the lift arms partially raised, to show the action of the linkage.
Figure 6:
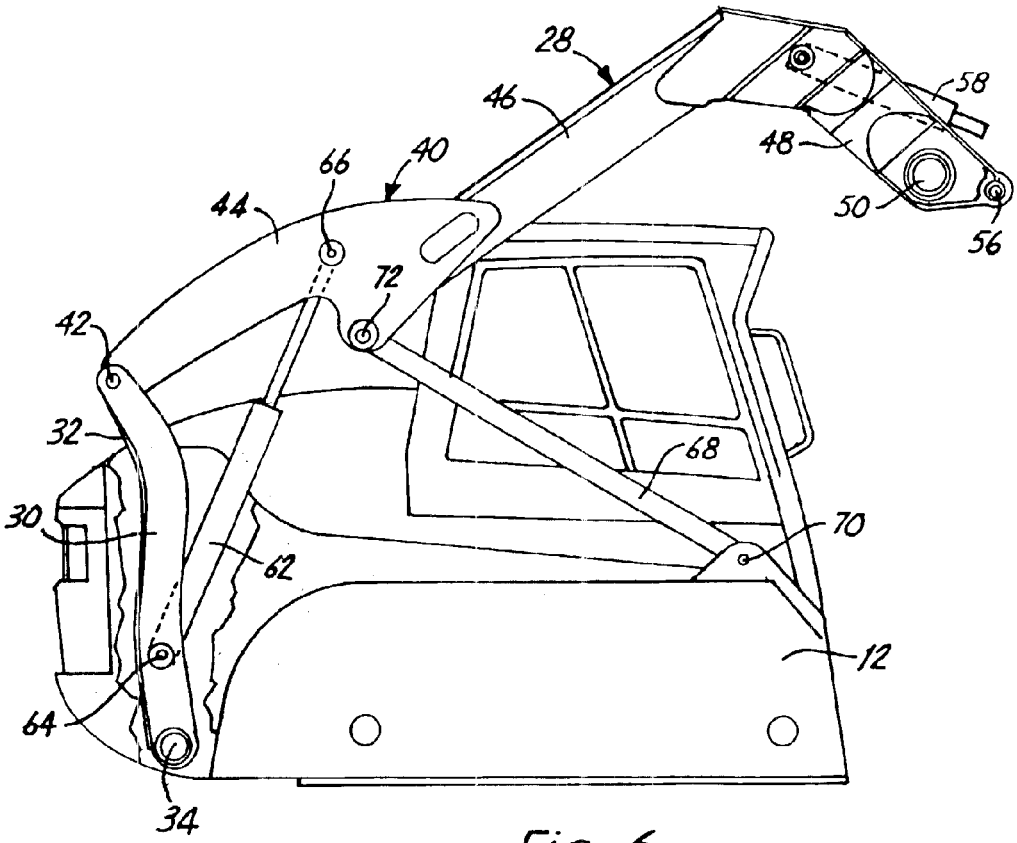
FIG. 6 is a view similar to FIG. 5, with the lift arms raised an additional amount.
Figure 7:
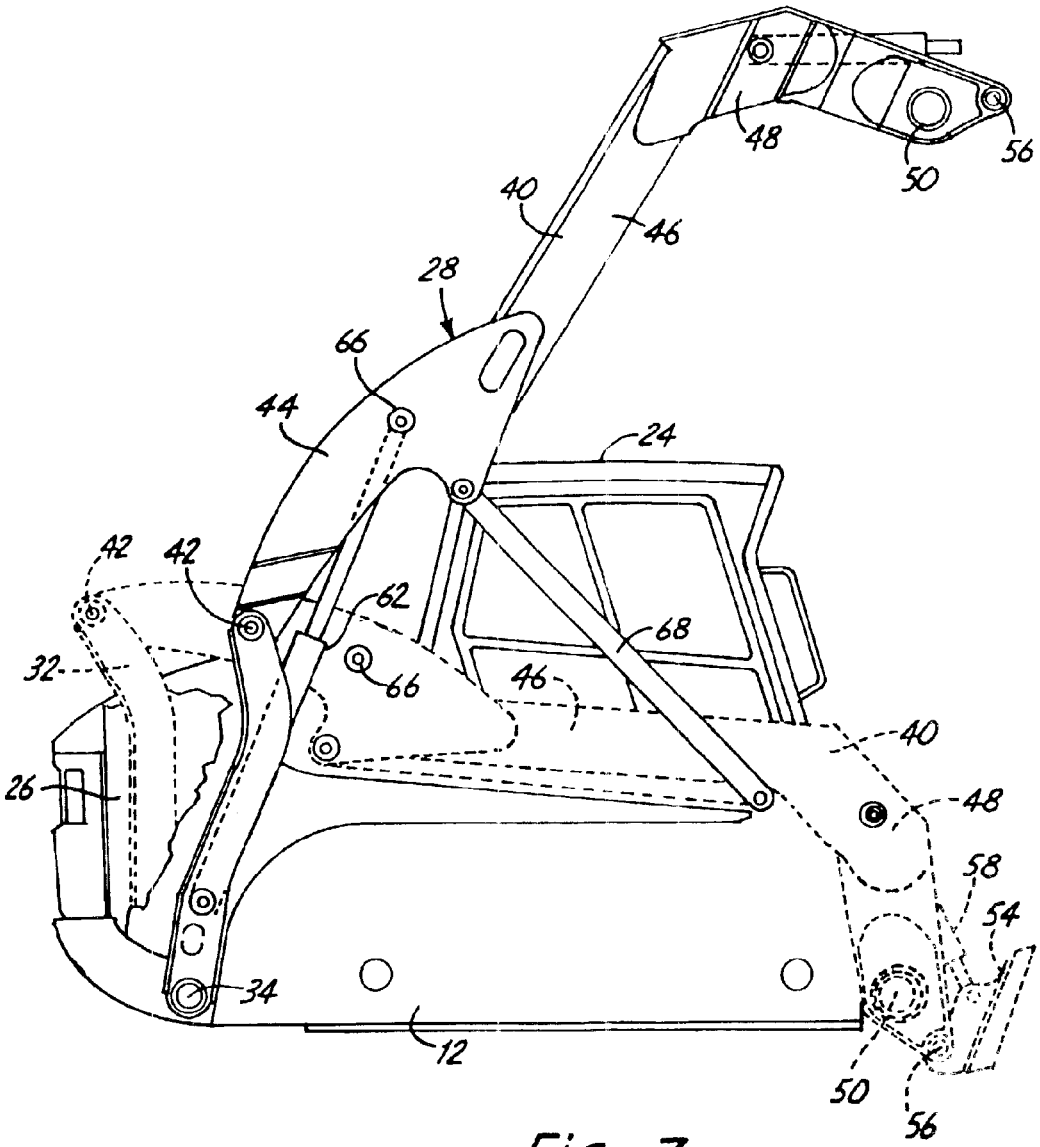
FIG. 7 is a view similar to FIG. 4, with the lift arms in a fully raised position.

One end of the cross tube 34 is shown in FIG. 1, as well as in FIGS. 4–7. In FIGS. 5–7, the side plate 26 has been broken away to show the upright link or post 32 on the right hand side of the loader. The lift arm assembly 28, as can be seen in FIG. 8, includes the main support links or posts 32 on the opposite sides of the skid steer loader. Lift arm assembly 28 also includes a pair of lift arms 40, on opposite sides of the skid steer loader, which are pivotally mounted as at 42 to the upper ends of the main upright links or posts 32, and as can be seen, each lift arm 40 fits between the plates 32A and 32B on its respective post 32 of the frame 30.

The lift arms 40 each include a pair of base end panels 44, joined to the sides of forwardly extending channel shaped arm sections 46. The forwardly extending channel shaped arm sections 46 have downwardly depending forward arm portions 48 which are joined together with a torsion tube 50 at their lower ends. The tube 34 at the lower rear of the loader and the torsion tube 50 at the front of the lift arms are the only cross members between the lift arms. It is a feature also that no cross members are at the rear of the operator's cab 24 other than the lower cross member 34. None are above the engine compartment or shrouding at the rear of the cab.

The depending forward arm portions 48 and brackets 52 (see FIGS. 2 and 8) support a front attachment plate 54 for attachment of a suitable tool or bucket, in a conventional manner. The attachment plate 54 is mounted about a horizontal pivot 56 on the downwardly depending arm portions 48 and brackets 52 attached to the cross tube 50.

Figure 2:
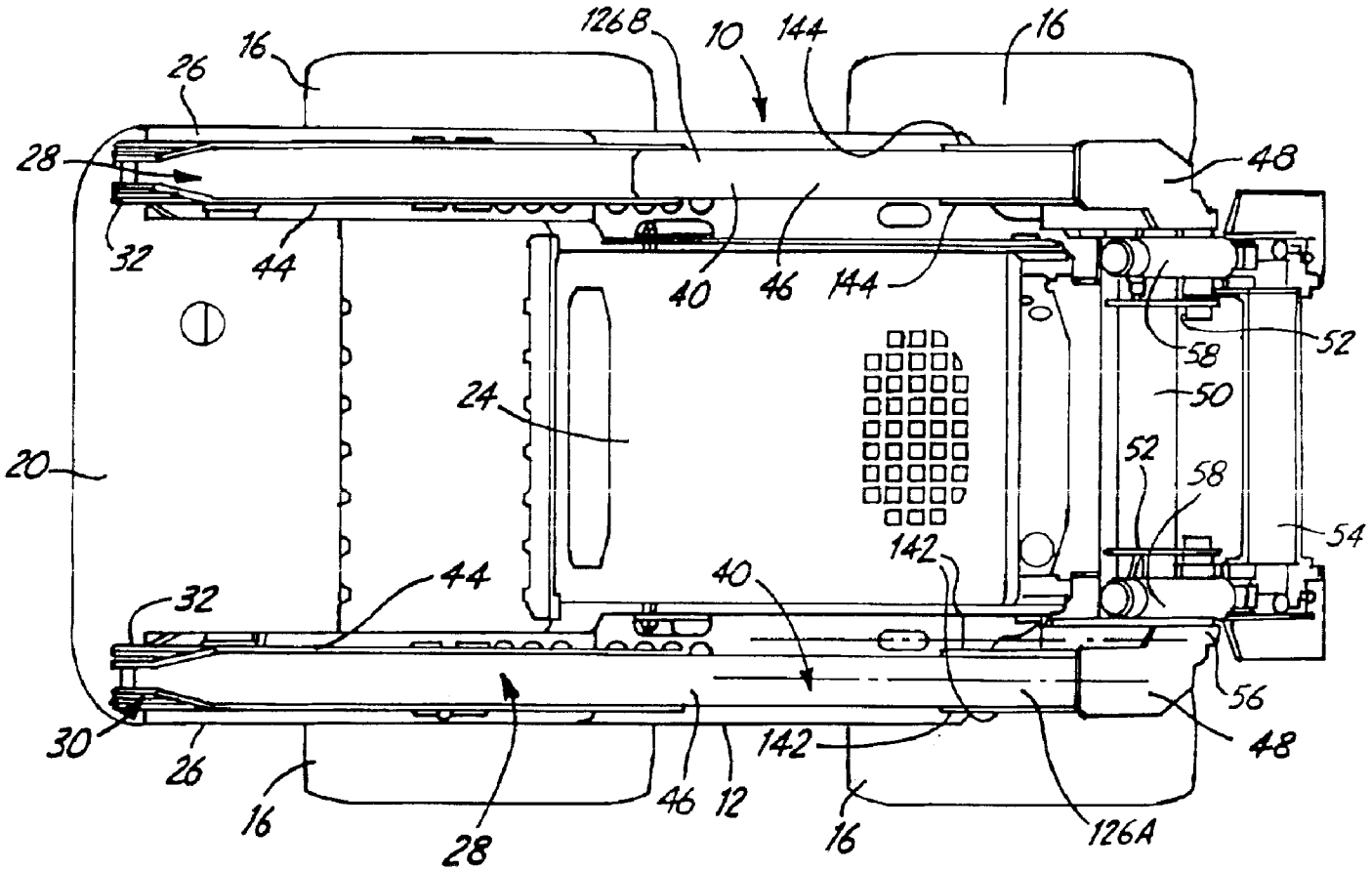
FIG. 2 is a top plan view of the skid steer loader of FIG. 1.
Figure 3:
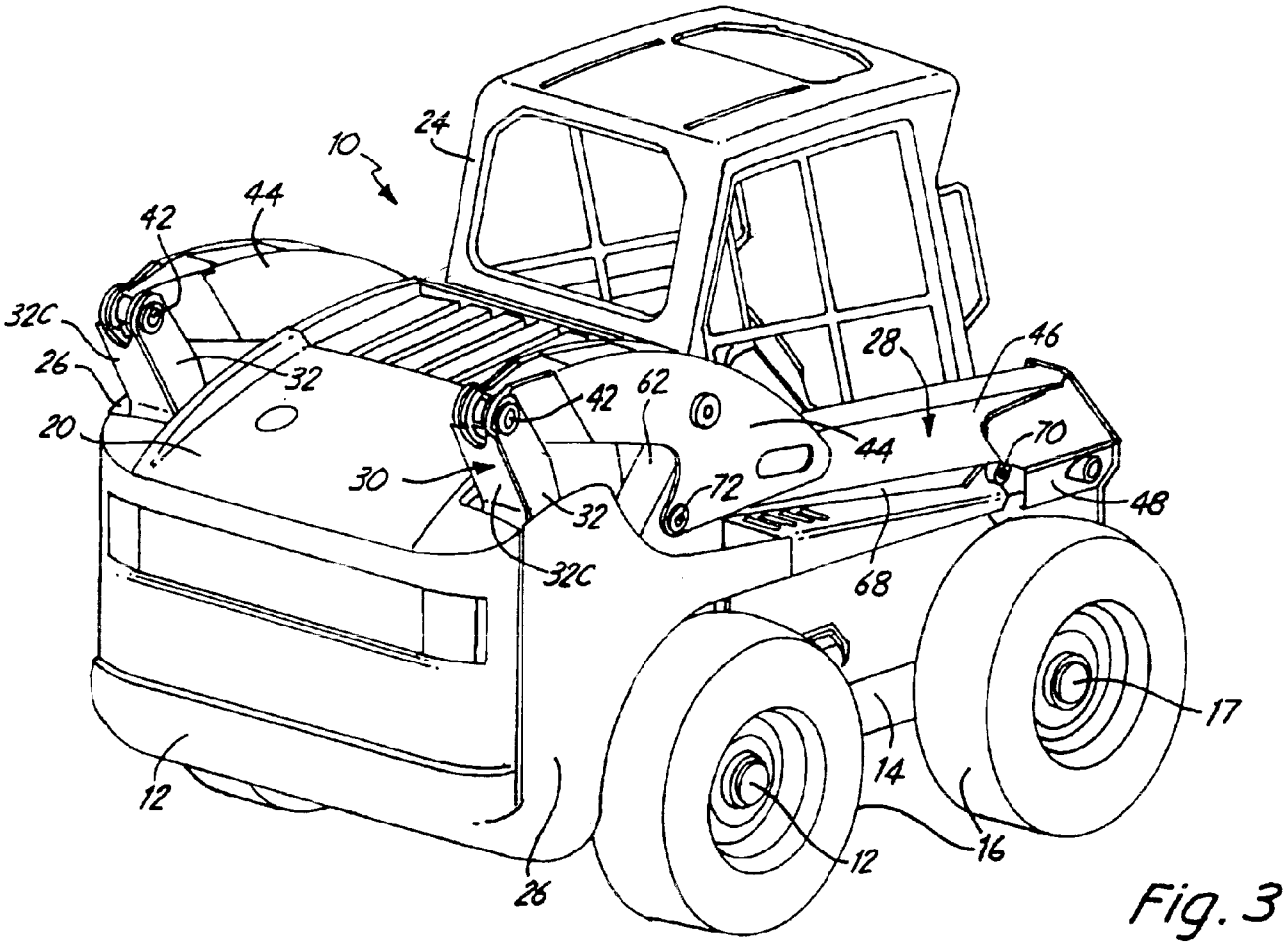
FIG. 3 is a rear perspective view of a skid steer loader of FIG. 1.

As can be seen in FIG. 2, suitable tilt cylinders 58 are supported at their upper ends on hubs, that are connected to the downwardly depending arm portions 48. The tilt cylinders control the pivoting of the attachment plate 54, and any attachment that is connected to the attachment plate.

Movement of the lift arm 28 assembly relative to the loader frame 12 is controlled by a pair of hydraulic actuators 62, one on each side of the loader frame. The actuators 62 are connected between the respective upright links or posts, and the base frame portions 44 of the associated lift arm 40. The base ends of the actuators 62 are connected at a common pivot axis 64 to the respective upright link or post 32. The actuators 62 fit between the plates 32A and 32B of each of the upright links or posts. The rod ends of the actuators are connected at pivots 66 to the base frame portions 44 of the lift arms 40.

The path of movement of the outer end of the lift arm assembly 28 is controlled by control links 68 on each side of the frame. Control links 68 have first ends connected as at 70 to the loader frame 12 on suitable brackets, and have second ends pivotally connected at pivots 72 to the base frames 44 of the lift arms 40.

Side lift arms portions 46 are inverted channels so that the control link 68 will fit between the channel legs of the lift arm portions 46, in the positions shown in FIGS. 4 and 8.

The lift arm assembly 28 thus can be made quite rugged by using the spaced apart plates 44 as shown for the base frames 44. The lift arms are controlled by the action of the hydraulic actuator 62 between the lift arms and the main upright links or posts 32. The control links 68 are selected in length and position of the end pivot connecting to provide a desired path of movement.

In the lowered position, with the hydraulic actuators 62 retracted, the support frame 30 and the upright posts 32 are at a rearward position, as shown in FIGS. 1 and 4. The hydraulic actuator 62 reacts and applies loads between pivotally connected portions of the lift arm assembly, and is not anchored to the skid steer loader frame. Thus, when the actuators 62 are extended by operating a portion of the valve 22 to provide hydraulic fluid under pressure from the pump 18, the rod ends of the actuators will move outwardly, or extend, and thus cause the lift arms 40 to move upwardly about the pivots 42. The pivotal movement of the posts 32 and the lift arm frame 30 about the axis of cross tube 34 is determined by the control links 68 as they move about pivots 70 to the forward portions of the loader frame.

The partially raised position of the lift arms shown in FIG. 5 shows a slight forward movement of the attachment point 56 for the attachment plate 54. As the cylinders 62 continue to be extended, the lift arms are moved to the position as shown in FIG. 6.

As can be seen in FIG. 6, the connection point 56 has moved farther upwardly, and on a generally vertical path between the positions shown in FIGS. 5 and 6. The upper end of main upright links or posts 32 of the frame 30 have moved forwardly from their most retracted position, by pivoting on the supports for tube 34 as guided by the control links 68. Control link 68's move in an arc about pivots 70, and also pivot about the pivot connections 72 to the base frame portions 44 of the forwardly extending lift arms.

Figure 9:
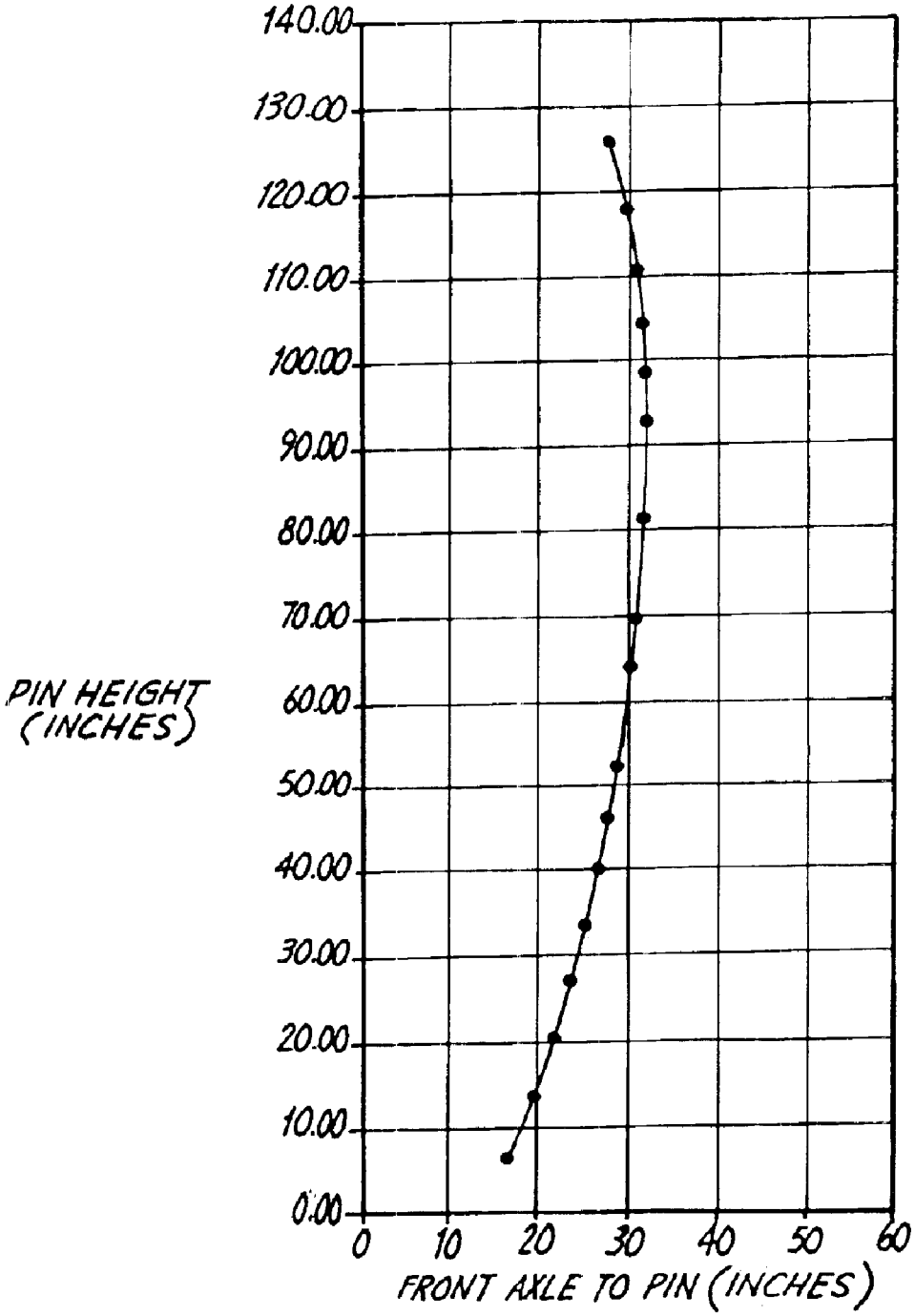
FIG. 9 is a plot of the path of movement of the tool connection pin at the outer end of the lift arms between a lowered and fully raised position.

FIG. 7 shows the lift arms in a fully raised position, with the actuator 62 fully extended. The control links 68 move the frame 30 and upright links or posts 32 by guiding the lift arm assembly forwardly. The attachment point 56 is kept from substantial rearward movement from its initial or lowered position. As shown in FIG. 9, the path of movement does move back or rearwardly slightly in its upper positions, but the attachment point moves substantially vertically from the midpoint of the path of movement to close to the maximum lift position.

The lift arm assembly 28 thus is self-contained in that the lift actuators or cylinders are between links or portions of the lift arm assembly, and are not acting between the loader frame and lift arms. The loads are reacted back to the loader frame through the mountings for the cross torsion tube 34. The position of the forward attachment end or point 56 of the lift arms, where the implement such as a bucket attaches, is controlled by links 68. The geometry is established by having two links or link assemblies of the lift arm assembly pivotally mounted together, and the angular position of the two links of the lift arm assembly about the pivot 42 between the links, is controlled by actuators extending between those two links or link assemblies. The positioning of an outer end of the lift arm, that forms one of the links or link assemblies of the lift arm assembly, is determined by the geometry of the pivotal mounting of a base end of the main or first link of the lift arm assembly to the loader frame, and a control link that ties the lift arm, or second link assembly back to the loader frame. The geometry is selected so that the movement of the outer end of the lift arm assembly will move in the desired path.

Although the present invention has been described with reference to preferred embodiments, workers skilled in the art will recognize that changes may be made in form and detail without departing from the spirit and scope of the invention.

What is claimed is:

1. A lift arm assembly for a self-propelled prime mover having a main frame which extends longitudinally and has forward and rear ends, and a power source on the main frame, the lift arm assembly comprising:

a first support link and a second lift arm link pivotally connected together at a first pivot, said first support link having an end opposite from the first pivot pivotally mounted on the main frame at a second pivot adjacent rear portions of the frame and adjacent a lower side of the main frame, said first support link extending upwardly along the rear end of the main frame, and said second lift arm link extending forwardly from the first pivot to a location adjacent the forward end of the main frame;

a control link having a first end pivotally connected to the frame adjacent the forward end of the frame, and having a second end pivotally connected to the second lift arm link at a location spaced in a forward direction from the first pivot; and an extendable and retractable actuator having a first end pivotally mounted to the first support link adjacent the second pivot, and having a second end pivotally mounted to the second lift arm link at a location spaced forwardly from the first pivot.

2. The lift arm assembly of claim 1, wherein the pivot of the second end of the control link is adjacent the pivot of the second end of the actuator to the second lift arm link.

3. The lift arm assembly of claim 1, wherein said control link has a length between pivots to move the first support link to a maximum rearward position with the second lift arm link lowered, and wherein the control link guides the movement of an outer end of the second lift arm link in a substantially vertical path as the actuator extends and retracts, the first support link pivoting to move the upper end of the first support link forwardly as the outer end of the second lift arm link moves upwardly.

4. The lift arm assembly of claim 3, wherein the control link is a fixed length link.

5. The lift arm assembly of claim 1, wherein said first support link extends upwardly above the loader frame, to position the pivot between the first support link and the second lift arm link a substantial distance above the second pivot.

6. The lift arm assembly of claim 1, wherein said control link is of a length such that as the actuator extends from a position with the second lift arm link lowered to a position with the second lift arm link at a maximum height, the pivot of the actuator to the second lift arm link moves from a position forwardly of the pivot of the second end of the control link, to a position rearwardly of the pivot of the second end of the control link.

7. The lift arm assembly of claim 1, wherein said control link is of a length such that an upper end of the first support link moves forwardly as the second lift arm link is moved upwardly to a raised position.

8. The lift arm assembly of claim 7, wherein said control link length and the pivot locations of control link on the frame and the second lift arm link, respectively, cause the second lift arm link to move in a substantially vertical path from a position substantially one-third of a travel path upwardly to adjacent a maximum upward travel on the travel path.

9. A method of moving a material handling tool in a lift path using a skid steer loader prime mover having a longitudinally extending frame, the frame having forward and rear ends, and the skid steer prime mover comprising a lift arm assembly including a first lift arm link and a second lift arm link, said first and second lift arm links being pivotally mounted together at first ends thereof about a first link pivot;

a second end of the first lift arm link being pivotally mounted to the longitudinally extending frame about a second lift arm pivot positioned at a rearward portion of the skid steer prime mover frame adjacent a lower side thereof, said first lift arm link extending upwardly from the second lift arm pivot to a position with the first lift arm link pivot substantially above the frame, the second lift arm link extending forwardly beyond the forward end of the skid steer prime mover frame, a control link having a first end pivotally mounted to a forward portion of the skid steer prime mover frame about a first control link pivot, and a second end of said control link being pivotally mounted to said second lift arm link about a second control link pivot located forwardly of the first link pivot, the method comprising providing an extendable and retractable actuator having a first end pivotally mounted to the first lift arm link adjacent the second lift arm pivot, and the actuator having a second end pivotally mounted to the second lift arm link about a second actuator pivot positioned forwardly of the first link pivot, moving an outer end of the second lift arm link between a lowered and raised position by extending and retracting the actuator, and controlling the movement of the outer end of the second lift arm link in a lift path that includes a substantially vertical path portion subsequent to lifting the outer end of the second lift arm link substantially one-third of a maximum upward travel location of the outer end to adjacent the maximum upward travel location.

10. The method of claim 9 including selecting the control link length to pivot the first lift arm link about the second lift arm pivot such that an upper end of the first lift arm link moves forwardly throughout the path of movement of the outer end of the second lift arm link.

11. A loader lift arm assembly for a self-propelled prime mover having a main frame which extends longitudinally and has forward and rear ends, and a power source on the frame comprising:

first and second lift arm links pivotally connected together at a first pivot, said first lift arm link having an end opposite from the first pivot to the second lift arm link comprising a second pivot for mounting to a loader;

said second lift arm link extending forwardly from the first pivot to the first lift arm link;

a control link having a first control pivot connection to the loader frame adjacent a forwardly extending end of the second lift arm link and the control link having a second end pivotally connected to the second lift arm link at a location spaced in a forward direction from the pivot between the first and second lift arm links; and an extendable and retractable actuator having a first end pivotally mounted to the first lift arm link adjacent the opposite end of the first link, and the actuator having a second end pivotally mounted to the second lift arm link at a location spaced forwardly from the first pivot between the first and second lift arm links.

12. The loader lift arm assembly of claim 11 wherein said control link has a length that causes the first lift arm link to be at a maximum rearward position with the actuator retracted and wherein the control link guides the movement of an outer end of the second lift arm link in a substantially vertical path while the opposite end of the first link pivots as the actuator extends.

13. The loader lift arm assembly of claim 12 wherein the control link is a fixed length link.

14. The loader lift arm assembly of claim 11, wherein said control link is of a length such that as the actuator extends the pivot of the actuator to the second lift arm link moves from a position aligned between the ends of the control link, to a position on a side of the second end of the control link between the second end of the control link and the first lift arm link.

15. A loader lift arm assembly for a self-propelled prime mover having a main frame which extends longitudinally and has forward and rear end, a power source on the frame and an operator station between the front and rear ends comprising:

a pair of lift arms, one for mounting on a respective side of a loader main frame, each lift arm comprising:

first and second lift arm links pivotally connected together at an upper ends of the first link, said first lift arm links having an end opposite from the pivot to the respective second lift arm link;

a first cross member secured to the opposite ends of the first link of each lift arm to form an assembly, the first cross member forming a pivot member adapted to be mounted to a lower rear portion of a loader frame;

said second lift arm links extending forwardly from the respective pivot to the respective first lift arm link on each lift arm;

extendable and retractable actuators pivotally mounted to the respective first and second lift arms and operable to pivot the respective first and second lift arm links relative to each other; and a second cross member between ends of the second lift arm links of the lift arms to form the lift arm assembly, with no other cross members between the lift arm links to a rear side of the operator station.

16. The loader lift arm assembly of claim 15 further characterized by the first and second cross members consisting of the only cross members between the respective lift arm links.

* * * * *

UNITED STATES PATENT AND TRADEMARK OFFICE

CERTIFICATE OF CORRECTION

PATENT NO. : 6,866,466 B2
DATED : March 15, 2005
INVENTOR(S) : Roan et al.

It is certified that error appears in the above-identified patent and that said Letters Patent is hereby corrected as shown below:

Column 8,
Line 4, “ends” should be -- end --.
Line 4, “links” should be -- link --.

Signed and Sealed this

Twenty-ninth Day of November, 2005

JON W. DUDAS
*Director of the United States Patent and Trademark Office*